US006454089B1

(12) United States Patent
Pease

(10) Patent No.: US 6,454,089 B1
(45) Date of Patent: Sep. 24, 2002

(54) CASES

(75) Inventor: John McNair Pease, Sedbergh (GB)

(73) Assignee: Dayover Limited, Bristol (GB)

( * ) Notice: Subject to any disclaimer, the term of this patent is extended or adjusted under 35 U.S.C. 154(b) by 0 days.

(21) Appl. No.: 08/535,149

(22) PCT Filed: Apr. 25, 1994

(86) PCT No.: PCT/GB94/00880

§ 371 (c)(1),
(2), (4) Date: Oct. 23, 1995

(87) PCT Pub. No.: WO94/24899

PCT Pub. Date: Nov. 10, 1994

(30) Foreign Application Priority Data

| | | |
|---|---|---|
| Apr. 23, 1993 | (GB) | 9308490 |
| Jul. 29, 1993 | (GB) | 9315741 |
| Sep. 16, 1993 | (GB) | 9319182 |
| Dec. 2, 1993 | (GB) | 9324745 |

(51) Int. Cl.[7] ..... A45C 5/12
(52) U.S. Cl. ..... 206/289; 206/278; 206/292
(58) Field of Search ..... 229/87.15–87.17; 206/278, 279, 289, 292–294

(56) References Cited

U.S. PATENT DOCUMENTS

| | | | | | |
|---|---|---|---|---|---|
| 1,036,661 | A | * | 8/1912 | Magee, Jr. | 206/278 |
| 1,159,743 | A | * | 11/1915 | Buxton | 206/278 |
| 1,438,738 | A | | 12/1922 | Witbeck | |
| 1,561,242 | A | * | 11/1925 | Kaye | 229/87.15 X |
| 1,758,230 | A | | 5/1930 | Lange | |
| 1,759,189 | A | * | 5/1930 | Fishman | 206/294 |
| 1,805,076 | A | | 5/1931 | Carlston | |
| 1,816,539 | A | * | 7/1931 | Lerman | 229/87.17 X |
| 2,027,119 | A | * | 1/1936 | Ritter | 229/87.15 |
| 2,039,383 | A | * | 5/1936 | Blumenstock | 206/294 X |
| 2,076,467 | A | * | 4/1937 | Krout | 206/278 X |
| 2,362,807 | A | * | 11/1944 | Dresner | 206/289 |
| 2,371,841 | A | | 3/1945 | Paulsen | |
| 2,458,116 | A | * | 1/1949 | Titus | 206/289 X |
| 2,686,580 | A | | 8/1954 | Donnelly | |
| 2,710,082 | A | * | 6/1955 | Ruge | 206/292 X |
| 2,764,280 | A | * | 9/1956 | Carper | 206/278 |
| 2,846,127 | A | | 8/1958 | Tomarin | |
| 2,856,110 | A | | 10/1958 | Cowan | |
| 2,873,830 | A | | 2/1959 | Wilt | |
| 2,974,837 | A | | 3/1961 | Boehmer | |
| 5,255,766 | A | * | 10/1993 | Deconinck | 206/293 X |

FOREIGN PATENT DOCUMENTS

| | | | | |
|---|---|---|---|---|
| DE | 1950962 | | 4/1971 | |
| DE | G89060245 | | 11/1989 | |
| EP | 0102100 | | 3/1984 | |
| FR | 549141 | | 7/1956 | |
| FR | 1416567 | * | 9/1965 | 190/109 |
| FR | 1417237 | | 10/1965 | |
| FR | 2225020 | | 10/1974 | |
| FR | 509935 A1 | | 10/1992 | |
| GB | 15.698 | * | 2/1915 | 206/278 |
| GB | 383061 | | 11/1932 | |

* cited by examiner

*Primary Examiner*—Gary E. Elkins
(74) *Attorney, Agent, or Firm*—Pearson & Pearson, LLP

(57) ABSTRACT

A packaging case for a folded shirt is in the form of a bag with top and bottom walls and a rigid reinforcement between the wall to prevent crushing of the shirt collar. The reinforcement may be stepped so that there is greater protection for the collar end of the bag. The reinforcement may be defined by stepped rigid side walls of the bag. The shirt may be folded around a frame within the bag and this may comprise top and bottom panels linked by a hinge joint which is curved to avoid creasing of the shirt. The bag has an opening closed by a lid or flap.

11 Claims, 7 Drawing Sheets

CASES

TECHNICAL FIELD

This invention relates to cases for packaging garments, particularly shirts.

BACKGROUND ART

It is difficult to avoid crushing or creasing shirts, especially in the collar region, when packaged in modern flexible luggage, or tightly packed briefcases, or in other circumstances where there is no protection against compression. Also, when shirts are loosely packed it is difficult to avoid collapsing and creasing especially when carried vertically.

This is particularly, although not exclusively, a problem for the business traveller who needs to have one or more changes of clothing ready for wear in fresh condition but who only has limited or cramped luggage space.

An object of the present invention is to provide a case in which a garment or garments can be conveniently packaged, so as to be maintained in fresh condition during transport or storage.

DISCLOSURE OF THE INVENTION

According to one aspect of the invention therefore there is provided a packaging case for a garment or garments comprising an outer bag structure defining an openable storage container having top and bottom walls thereto, and a reinforcing structure providing transverse rigidity between said walls, characterised in that this rigidity is restricted to, or extends over a greater height between the walls, at one end region of the storage container relative to an opposite end thereof.

With this arrangement, in effect the packaging case has 'stepped' rigidity suited to protected packaging of a folded shirt with the collar located at the said one end region and the remainder of the shirt extending towards the opposite end region.

According to a second aspect of the invention therefore there is provided a method of packaging a shirt using a case as described above wherein the shirt is folded and inserted into the case with the collar of the shirt at the said one end region and the remainder of the shirt extending towards the opposite end region.

The use of stepped rigidity facilitates stacking of two cases one turned over and rotated through 180° relative to the other so that the top walls of the two cases confront and contact each other with the said one end region of each against the said other end region of the other.

Two or more cases, containing different changes of clothing, can therefore be conveniently packed in a briefcase, or other luggage so that multiple fresh changes of clothing can be carried.

Provision may be made for releasably interconnecting such stacked cases. Also if desired provision may be made for releasably interconnecting cases side by side or otherwise.

With regard to the outer bag structure this is preferably stepped or inclined correspondingly to the above mentioned stepped rigidity i.e. so as to be of a greater height at said one end region relative to said opposite end. In one embodiment, the bottom wall may be arranged to be wholly or mainly flat whereas the top wall may be arranged to have two separate flat portions, corresponding respectively to the said end regions, with an inclined joining portion therebetween. The top and bottom walls may be linked by edge walls around the entire periphery, or at least a major portion of the periphery, and these may be of different heights at opposite ends, and of stepped height along the sides, in conformity with the stepped configuration. Instead of this three-part stepped top wall it is possible to use a single, or two-part inclined top wall.

Instead of an overall stepped or inclined bag structure it is possible to have a bag structure which has a stepped or inclined compartment. For example the bag may be rectangular with an inset upper compartment at the said other end region leaving a stepped or inclined compartment in the remainder of the bag structure. Indeed, the term bag structure as used herein is intended to cover rigid or self supporting box containers as well as bags of a flexible or partly flexible or soft nature.

The bag structure may be formed from flexible material such as textile fabric and/or plastics sheeting and/or leather and this may be appropriately cut and seamed or molded to form the desired shape. A zip fastener, or VELCRO fastener or any other suitable fastener may be provided along an openable flap or mouth to provide access to the interior of the bag structure. Stiff, semi-stiff or rigid materials can also be used as also can other fasteners such as studs or snap fasteners.

The reinforcing structure may additionally provide rigidity other than in the said transverse direction to effect, or assist, maintenance of the desired overall shape of the bag structure. Thus, the reinforcing structure may include a planar portion extending over the inner surface of the bottom wall of the bag structure.

With regard to the reinforcing structure, this may comprise one or more rigid parts formed integrally with or comprising an integral part of, and/or separate to and located within the bag structure. The term 'rigidity' is intended to cover parts having sufficient rigidity or stiffness to provide substantial resistance to crushing of a shirt and especially a shirt collar under compression normally encountered in packing and handling of luggage. Thus, semi-rigid parts from materials such as card, self-supporting resiliently deflectable plastics sheeting, and the like can be used.

The reinforcing structure may comprise rigid transverse edge walls, i.e. edge walls extending in the transverse (upright) direction between the top and bottom walls and which are inherently rigid or which have rigid frames applied thereto.

Additionally or alternatively, the reinforcing structure preferably comprises a flat back part which overlies the inner surface of the bottom wall of the bag structure and an integral upstanding tab section at one end which extends within the said one end region of the bag structure. Preferably also this structure is removable from the bag structure so that it can be used as a shirt frame around which a shirt can be folded with the shirt collar engaged with the tab section.

The shirt frame may have great rigidity in a transverse direction between the side edge walls parallel to the top and bottom walls, and in this case the side edge walls of the bag may be partly or fully flexible in such transverse parallel direction.

In a preferred embodiment there is provided a collar reinforcement, preferably adapted to provide or contribute to the transverse rigidity at the said one end region, and which is arranged to fit around the periphery of a shirt collar to hold the collar in shape, particularly by fitting within the collar. This may take the form of a generally triangular or oval or circular frame which is preferably of adjustable size, e.g. by expansion of one side, to correspond to different collar sizes.

In a particularly preferred embodiment this collar former is made from a strip which can be folded and retained in shape by interconnection of its ends at a position selected from a range of positions e.g. by engagement of a snap fit fastener, such as a stud, or cut-outs with a selected one of a row of cooperable members.

Additionally, there may be a separate front collar support tab that is either integral to the one piece collar reinforcement or is separately attached to it by means of one or more studs or other fasteners. This collar support can fit under the front wings of the collar with a middle tab section that rises between these wings and folds back on itself into the inside of the collar where it is fastened onto the collar reinforcement.

Preferably also there is provided a supplementary container for small garments, such as underwear, locatable within the bag structure, and conveniently this may be shaped and dimensioned to fit within the collar of a shirt. Thus, for example, the container may comprise a generally triangular or curved or oval bag which can fit within a shirt collar when the collar is supported by the above mentioned generally triangular or curved or oval frame, and preferably incorporates internally such frame. In this case such a fastener may cover only say 70% of the bag circumference so allowing the bag to be squeezed into smaller collar sizes. This bag may have a closeable opening, e.g. a zipped mouth or flap or the like.

The case may also incorporate other garment storage or retaining devices. For example an elasticated strap or a retaining flap with appropriate slots or a further pocket with or without a zipped closure may be attached to an inner surface of the bag structure, or to a part of the reinforcing structure, so that cuff links or other personal valuables or toiletries can be securely retained by the structure.

One embodiment of the invention is characterised by the provision of a supplementary storage compartment, said compartment being arranged at the said opposite end region of the case. Preferably, the supplementary storage compartment is detachably mounted externally on the top wall of the case. It may also be incorporated detachably or integrally internally.

As mentioned above, the packaging case preferably incorporates a shirt frame.

Thus, and in accordance with a further aspect of the present invention there is provided a frame, particularly although not exclusively for use in performing the above described method, said frame comprising first and second flat panels joined by a hinge whereby the panels can be bent or pivoted about the hinge to lie one on top of the other with an article folded around the panels, characterised in that the hinge is arranged to bend or pivot to form a curved transition between the panels. In this way creasing can be avoided as the article is folded over the hinge. The article is preferably a shirt but may be another garment or textile article or the like.

Preferably the hinge is defined by a strip with multiple side by side lines of weakness. Preferably also, the panels and the strip are formed integrally in one piece. An upstanding tab may be provided at a top end of a top one of the panels for engagement with the shirt collar.

Although particularly suited for the packaging case of the present invention, the shirt frame may also be used in any other suitable packaging.

BRIEF DESCRIPTION OF THE DRAWINGS

The invention will now be described further by way of example only and with reference to the accompanying drawings in which.

BEST MODES OF CARRYING OUT THE INVENTION

Figure 1:
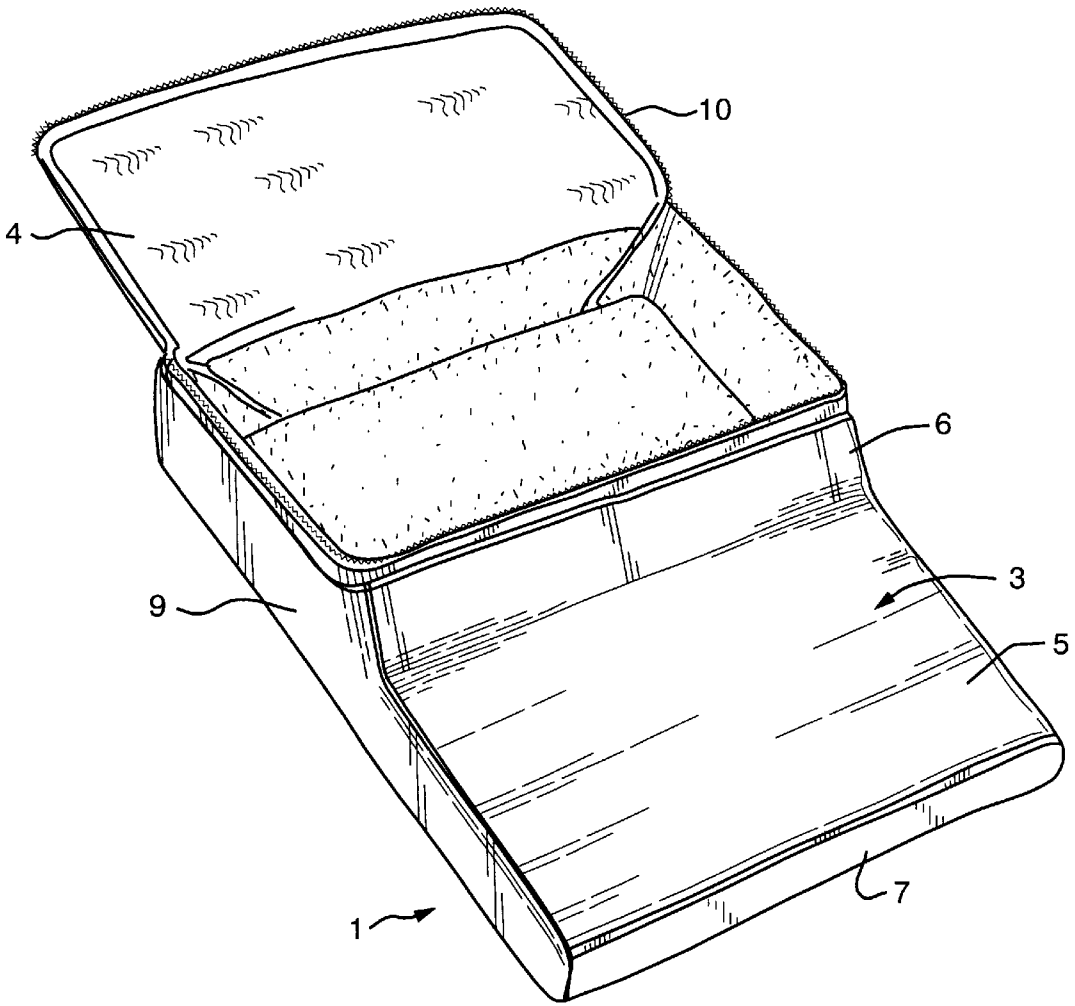
FIG. 1 is a diagrammatic perspective view of one form of a case according to the invention.

Referring to the drawings, there is shown in FIG. 1 a case for packaging a shirt and small additional garments (such as socks and underpants) suitable for an overnight change of clothing for a business traveller.

The case is of stepped formation and has an outer bag structure 1 made from soft flexible fabric or plastics or leather sheeting which provides a flat rectangular bottom wall 2, a top wall 3 having two flat rectangular parts 4, 5 at different heights linked by an inclined intermediate strip 6, two strip shaped end walls 7, 8 of different heights, and two like stepped side walls 9.

There is a zip 10 around three sides of the upper top part 4 so as to define an openable flap to provide access to the interior of the bag 1.

The various walls 4–9 may be formed by one or two or more sheets appropriately folded and joined at edges. The sheets may be wholly flexible. Alternatively, if desired the side walls 7–9 (or some of them) may be formed from (or may incorporate) rigid or semi-rigid sheet material such as cardboard or molded plastics to retain the stepped shape of the case.

Figure 3:
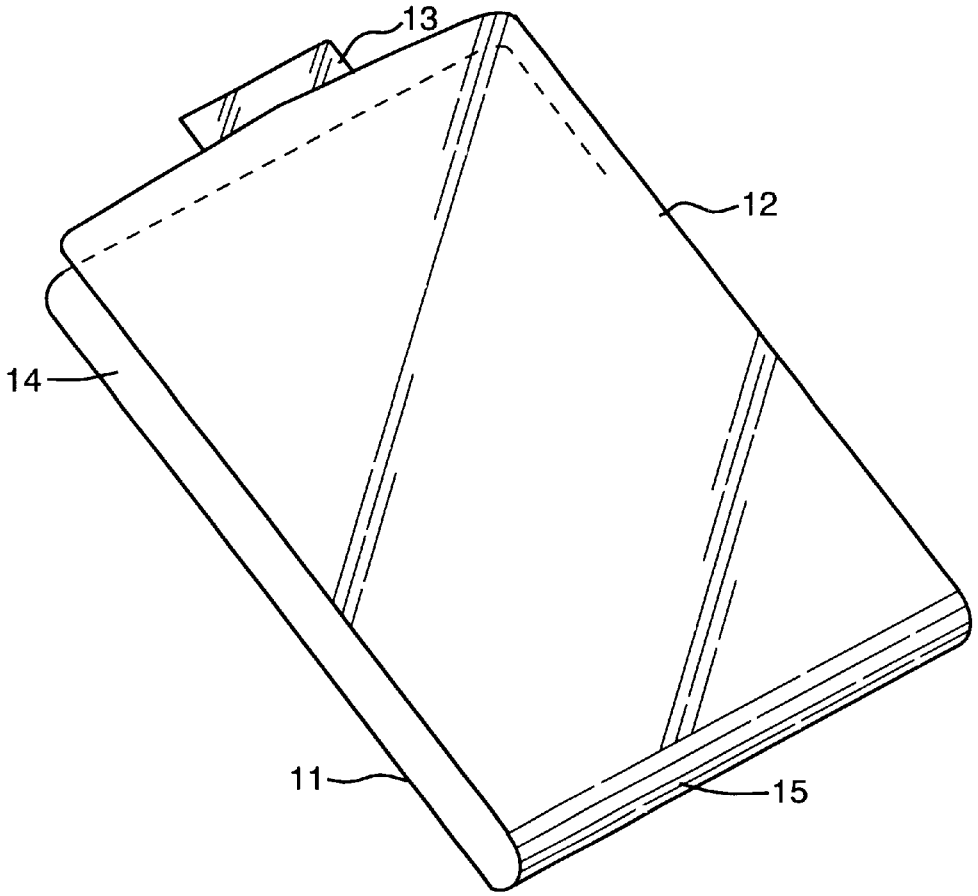
FIG 3 is a diagrammatic perspective view of an internal shirt frame in folded condition.

Within the bag structure 1 there is a shirt frame 11, as shown in FIG. 3 which has a generally rectangular flat back panel 12 with an upstanding tab section 13 at one end. This frame is a rigid, or semi-rigid structure formed from e.g. molded plastics.

A shirt can be folded around the back part 12 with the collar engaged with the tab section 13.

The frame 11 is dimensioned so that the back part 12 overlies and is of similar size to (but slightly smaller than) the inner surface of the bottom wall 2 of the outer bag structure 1 with the tab section 13 projecting upwardly adjacent the end of the bag structure 1 beneath the higher top part 4.

Preferably, although not essentially, and as shown in FIG. 3 of the drawings, the shirt frame has an extra back hinged section in the form of a flat panel 14 that will allow easier folding of the shirt along a greater length. Also greater rigidity can be attained and folded socks or other flat articles can be accommodated between the two folded panels 12, 14. All edges and particularly the outer edges of the hinge section are radiussed to avoid shirt creasing. In particular the hinge joint is defined by multiple side by side parallel crease lines or grooves or other lines of weakness in a strip 15 joining the top and bottom flat panels 12, 14, such panels 12, 14, the strip 15 and the tab 13 being formed in one piece.

The folding shirt frame, may have an elastic strap connectable between folding top flaps (at top corners of the top panel) with a stud (or other) fastener to secure the shirt to the frame in an easy to pack form. Also the shirt frame back may have an elasticated strap (not shown) fastened across its lower surface for retaining a pair of socks or other small garments.

As stated in order to minimise creasing, the hinge joint is preferably formed from multiple creases or hinge lines which form, or approximate to, a curved bend when the frame panels are folded over.

The frame may be made from polypropylene sheeting which is cut and creased in one operation. It may also be made in any other manner from any other material such as plastics, wood, light metal such as aluminium, and with the hinge formed integrally or being a separate attached structure such as bonded fabric or other material. Weight may be saved in this frame by molding to produce a lattice so giving a honey-comb effect. Molding can also enable points on which to mount retainers for socks to be created as outlined in the original application.

The upstanding collar tab may be formed by creasing as well as molding. It does not have to be rigidly at 90° to the main body of the frame.

The rolling hinge is used to prevent the creation of transverse creases across the shirt front after the shirt on its frame has been folded back on itself causing the shirt to be pulled tightly against the rolling hinge.

Further such rolling hinge has the function of separating the two flat panels when folded over allowing space for the shirt folded at the rear to be accommodated along with personal items of clothing such as socks, a tie, silk scarf, underclothes, handkerchief etc.

The panels and the joining strip of the shirt frame may be formed in two pieces including the lower flat surfaces together with the rolling hinge which may as required be attached to the upper panel having the collar locating tab.

Figure 4:
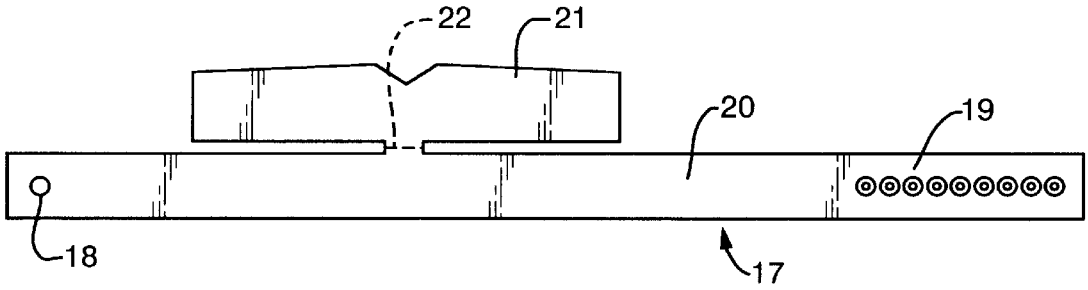
FIG. 4 is an opened out plan view of an internal collar former.

FIG. 4, shows a collar former which is fitted within the shirt collar to retain its shape. This is formed from a strip of semi-rigid (springy) molded plastics which is bent around into a generally triangular shape, the ends of the strip being held together by snap-fit engagement with a male stud 18 on one end with a female stud 19 selected from a row of such studs at the other end. By selection of the female stud 19, the size of the collar former can be adjusted to suit the collar size.

This collar former 17 comprises an elongate rectangular strip 20 with a central wing structure 21 which is folded over through 180° at the narrow neck part 22 to stiffen the front part of the collar.

This collar former 17 fits within the shirt collar with the shirt on the shirt frame of FIG. 3. The collar former 17 itself may fit within a generally triangular bag (not shown) made from flexible fabric or plastics sheeting having a zipped top flap; with the main strip 20 within the bag and the wing structure 21 protruding out of the bag through an opening.

This bag provides packing space for underpants or other small garments.

The wings 21 are tucked under the collar at the front and then the triangular part of the former 17 (within the bag) is dropped into the neck of the shirt within and in contact with the collar.

Figure 5:
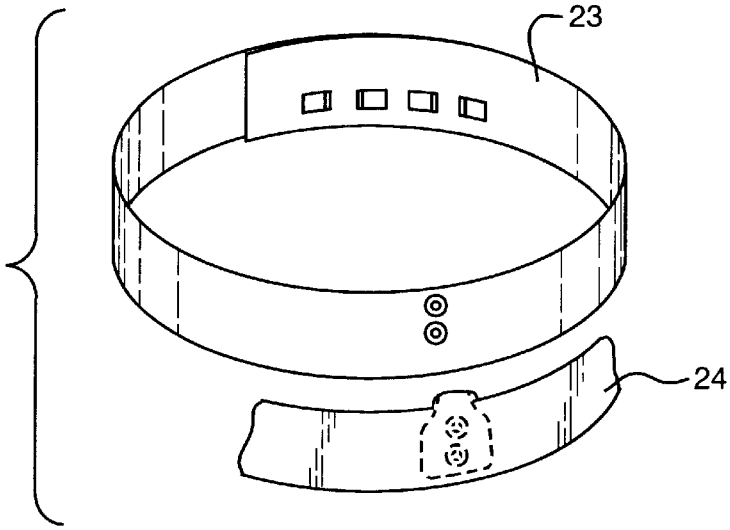
FIG. 5 is a top view showing an alternative form of collar former in assembled condition.

FIG. 5 shows a modified version of the collar support which can be used with the packaging case of the invention. The collar support is in two pieces 23, 24 to be joined by two studs to ensure vertical alignment and interlocking cut-outs (e.g. tabs and slots) are provided to join the ends of the main support 23.

Additional bags, containers, pockets may be provided in or on the case as desired for storage of different articles. For example the bottom wall of the case may incorporate an internal pocket e.g. for handkerchief. The internal bag within the shirt collar may have an internal pocket e.g. for cuff links.

Figure 6:
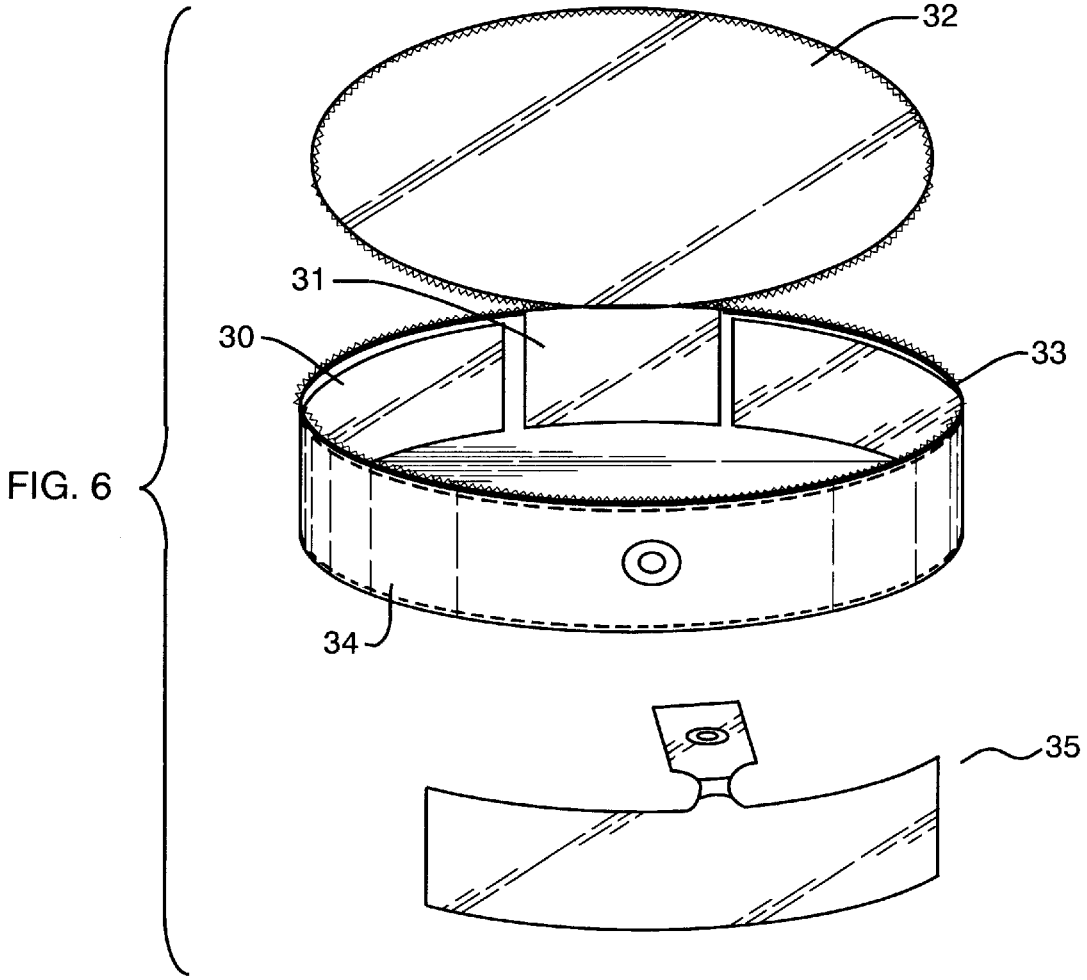
FIG. 6 is an exploded view of an alternative collar bag.

FIG. 6 shows in exploded view an alternate bag (personal bag) to fit and protect the collar.

Firstly the collar is supported by a strong springy length 30 of polypropylene or similar plastic. That does not completely extend around the side wall, and there is a separate inserted rear panel 31. This allows the bag to be squeezed from the sides and so allow the bag to be inserted into collar sizes smaller than the personal bag. Once the side pressure is released on the bag then the natural springiness of the plastic wall pushes the side outwards to fit snugly inside the shirt collar. The bag has a lined top cover 32 fastened by a zip 33 to the lined body 34 of the bag. Secondly the separate hinged collar support 35 is placed under the front section of the collar prior to inserting the personal bag inside the collar. It prevents the important front part of the collar collapsing especially when the collar sizes are larger than the size of the personal bag. A further advantage of this is that the thicker springy plastic in the side wall allows the package to withstand much greater vertical (transverse) pressure on the collar without it being crushed.

Figure 7:
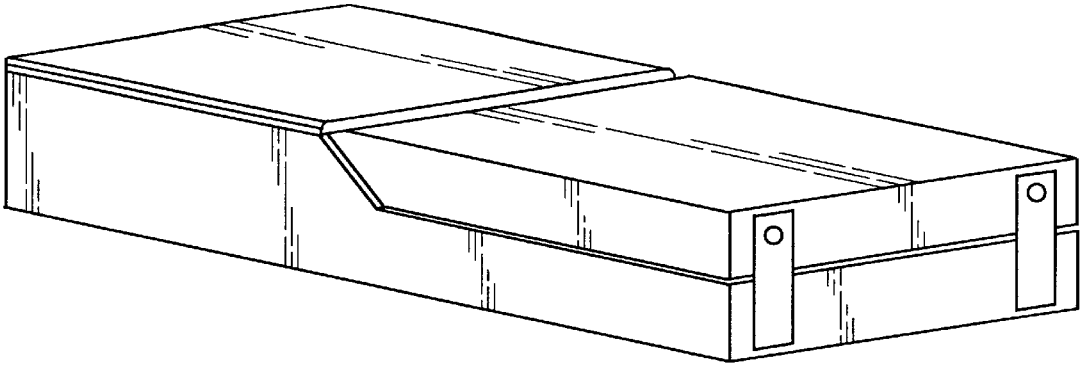
FIG. 7 is a perspective view of a case with an additional toiletries container.

Accompanying FIG. 7 shows an optional addition to the packaging case in the form of a toiletries bag which releasably attaches e.g. by press studs or Velcro etc. on the reduced height part of the stepped case. This may have internal compartments.

Instead of using an inserted or attached reinforcing structure, stepped rigidity may also be derived from the use of a sheet material which in itself has a requisite rigid nature. Also, part or all of the material used for the case may be transparent.

Thus, the case may be formed from transparent plastics sheet material of a semi-rigid (i.e. flexible but self-supporting) nature which is folded and seamed (e.g. by high frequency welding), with a top or rear flap e.g. fixed with press studs.

This embodiment may be used as a replacement for traditional display packaging for a new shirt, and the purchaser of such a packaged shirt can re-use the packaging as a shirt case. The packaging would contain a collar support, but not necessarily any supplementary container or bag or pocket whereby the case can be made as a simple relatively inexpensive structure.

Where the case is formed from non-transparent material there may be a rear window of transparent material or which is an opening to reveal the packaged shirt.

When the case is made from a rigid or semi-rigid material, e.g. a strong plastics sheet material such as ABS or polypropylene material, there may be a hinged lid to provide access at the top. The lid may be hinged at the top end of the case, or elsewhere as desired and the lid may be retained closed in any suitable manner, e.g. by means of a flap which tucks in or overlaps and is fixed by Velcro or press studs, or otherwise.

The additional bag where provided may be formed from rigid or semi-rigid sheet material as mentioned above and may also have a hinged lid which may be retained closed in like manner to the abovementioned lid of the case.

The additional bag is preferably shaped to conform closely to the shape of the 'step' of the case. Thus, for example, the arrangement may be such that the case with attached bag forms a rectangular (or generally rectangular) box structure.

The additional bag may be permanently or releasably attached to the case. In one embodiment the bag and the case are formed integrally, e.g. being defined by a two-compartment box structure.

The various possibilities mentioned above in relation to a case formed from rigid or semi-rigid material may also be applied, as appropriate to a case formed from flexible material. For example, a flexible material case may have a flexible or rigid or semi-rigid lid which is retained closed by an overlapping flap attached by Velcro or other fastener to the adjacent surface of the case.

A case and/or additional bag according to the invention may be formed from any suitable flexible, rigid or semi-rigid material or combination thereof.

The single case, or the single case with its attached toiletries bag or a combination of two cases inverted and clipped on each other may be carried externally as combined packages by means of handles or of shoulder straps attached to the clipped combination.

The case made from a rigid or semi-rigid strong, self-supporting sheet plastics material, e.g. ABS or polypropylene which may be made from one piece folded and welded or bonded, or otherwise fixed together, or from a plurality of pieces bonded or welded or otherwise fixed together. The case has a top hinged lid with a tuck-in flap. The lid is hinged at the top end of the case but it could be hinged at the opposite edge of the lid or at a side edge. The flap may overlap the adjacent outer inclined surface of the case instead of being tucked in and Velcro or magnetic or press stud or other fastener may be used to retain the flap. Alternatively zips may be used.

FIG. 7 shows the case with an additional toiletries bag which can be releasably fastened in the 'step' of the case as mentioned above. The bag is shaped so that with the case a rectangular structure is formed. The bag may be formed in like manner to the case and may have a lid with a tuck-in or overlapped flap. The lid may be hinged otherwise than at the edge shown.

Figure 8:
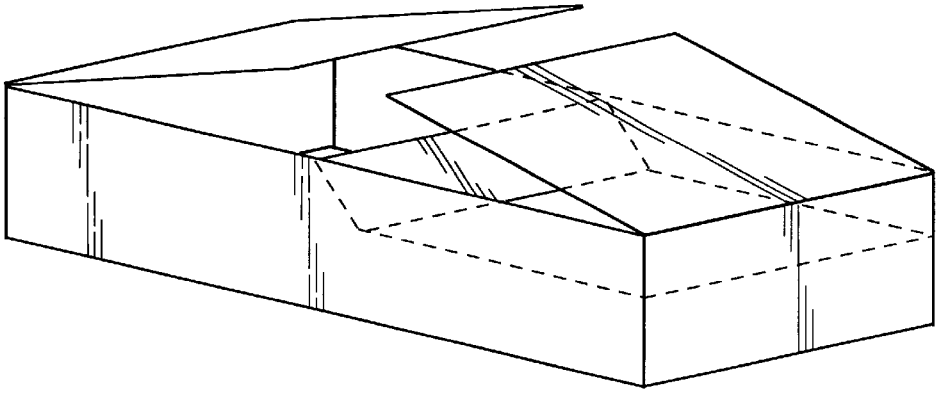
FIGS. 8 & 9 are perspective views of alternative case constructions.

FIG. 8 shows an integrated case and additional bag defined by a two-compartment box structure. The structure may be formed from a rigid or semi-rigid sheet material as mentioned above or from any other material or combination of materials including the soft covering materials and stiffer materials already mentioned. The lid may be hinged otherwise than as shown.

Figure 9:
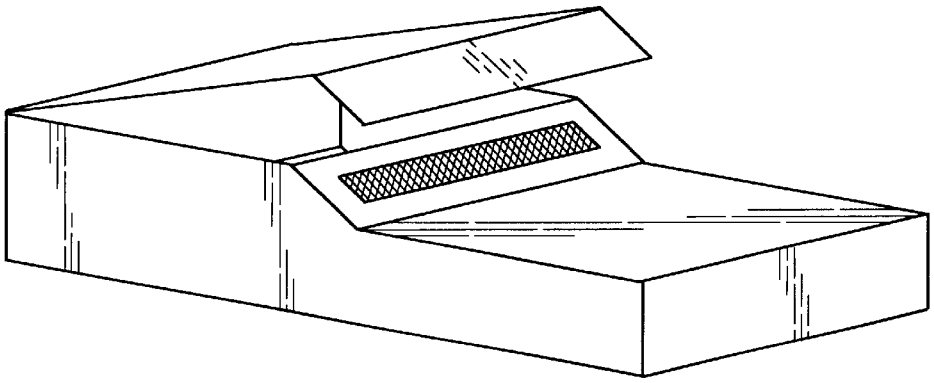

FIG. 9 shows a case made from any suitable material or combination of materials with a lid with an overlapping flap which can be retained by Velcro or magnetic studs or press studs or otherwise. This may be used with an additional bag as shown in FIG. 7 so that the flap then overlaps and is retained on the top surface of the bag. This arrangement may be more suitable for use with a rigid or semi-rigid case structure.

In this situation where the combined or integral cases are used as external luggage, provision may be made for external pockets to be added to carry tickets, passports, wallets etc. along with the carrying straps or handles.

With the arrangements described a shirt and other small garments sufficient for an overnight change of clothing are conveniently packaged and protected against crushing or creasing even if the case is carried with a tightly packed brief case or flexible hand luggage. This is because the vulnerable collar region of the shirt is protected by the transverse rigidity between the top and bottom walls of the case due to the rigidity of the side walls 9 and/or the tab section 13 of the shirt frame 11 and/or the collar former 16.

The shirt is held tightly in its folded position, and is protected against 'vertical' collapse (i.e. between the top and bottom walls) due to the fact that the shirt is held tightly in position between the edges of the shirt frame 11 and the closely adjacent walls of the outer bag structure and also due to the packing and support action of the collar former 16, the secure locating action of the tab section 13 of the shirt frame, and the abovementioned transverse rigidity.

Figure 2:
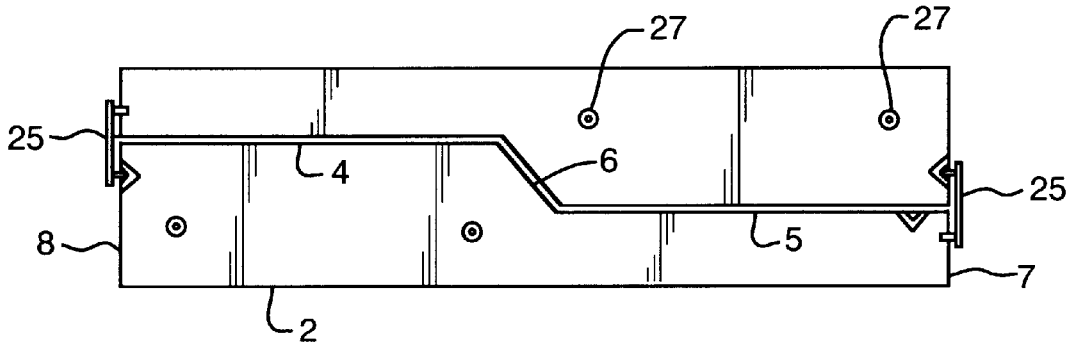
FIG. 2 is a side view showing two cases stacked one on top of the other.

As shown in FIG. 2, two cases, respectively containing two changes of clothing, can be conveniently packed in stacked conformation with one case turned over, and rotated through 180° relative to the other. The higher stepped end of one case therefore fits against the lower stepped end of the other case giving an overall generally rectangular pack.

The cases may be held together by links 25 which are fastened to the lower height ends 7 of the cases and snap fit into connectors on the other ends 8.

Provision may also be made (e.g. by snap-fit male & female studs 27) to hold cases side-by-side.

It is of course to be understood that the invention is not intended to be restricted to the details of the above embodiments which are described by way of example only.

As mentioned, if desired the bottom and/or top walls of the bag structure may be wholly or partially stiffened by incorporation of suitable stiff or rigid or semi-rigid sheet material, or by formation from such materials.

The case may be made from thin polypropylene sheeting using a die cut process.

The case may be used for purposes other than overnight travel or packaging of new shirts e.g. it may be used in laundries to package cleaned shirts.

Instead of using an angular stepped case it may be curved stepped, or curved or inclined without steps. The bag may have side supports for rigidity along the two long side edges but may otherwise be flexible. Other rigidity is derived from the shirt frame which in this case means that the outer case, which can be formed from tough nylon or canvas or leather or other such flexible materials, can be folded longitudinally.

It is also possible to rely on rigidity of the shirt frame, collar former and collar support alone to protect the folded shirt in which case there may only be the requirement to have a pocket in a case or a simple flexible bag without any form of stiffness to enclose the packed shirt, especially if it fits closely to the packed shirt.

The frame may have holes or recesses for the shirt buttons. These may be elongated and/or enlarged to accommodate different button sizes and positions.

Multiple shirts can be packaged in multiple cases formed integrally and/or adapted to be removably attached side-by-side and/or one on top of the other.

Two pairs of cases each having a top end access opening with a closure flap are linked by a flexible hinge so that the pairs can be folded over on top of each other and held together by studs or otherwise. Carrying handles or the like may be provided for the folded over assembly.

In this case, in addition to the possibility of an angular (or curved) stepped shape, the cases may be wedge-shaped with a sloping top surface made from soft or stiff material, or soft molded plastics or other material. The top surfaces and/or other surfaces of the cases may be wholly or partially transparent.

Figure 10:
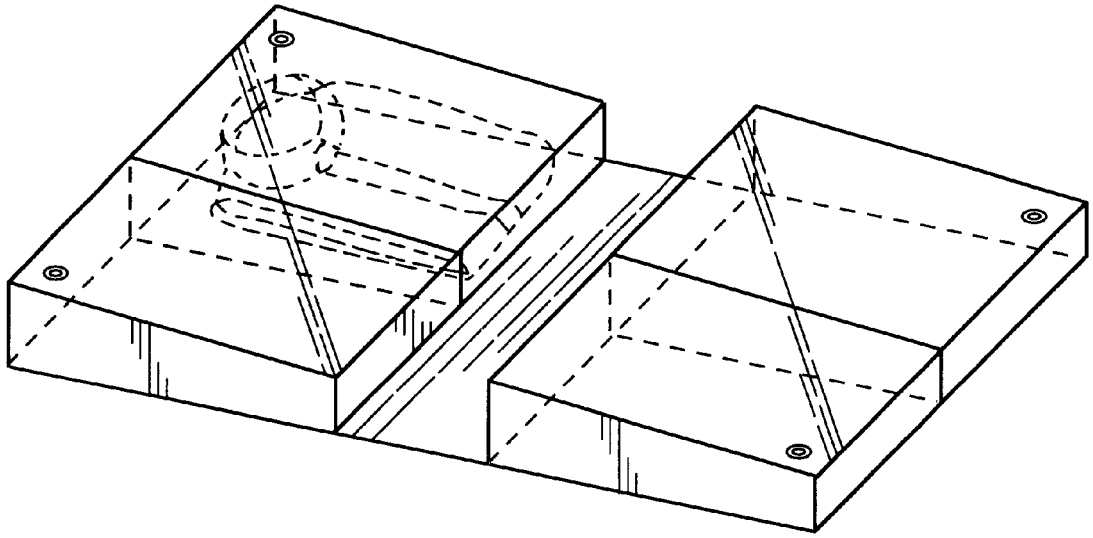
FIGS. 10–12 shows assemblies of multiple cases.
Figure 11:
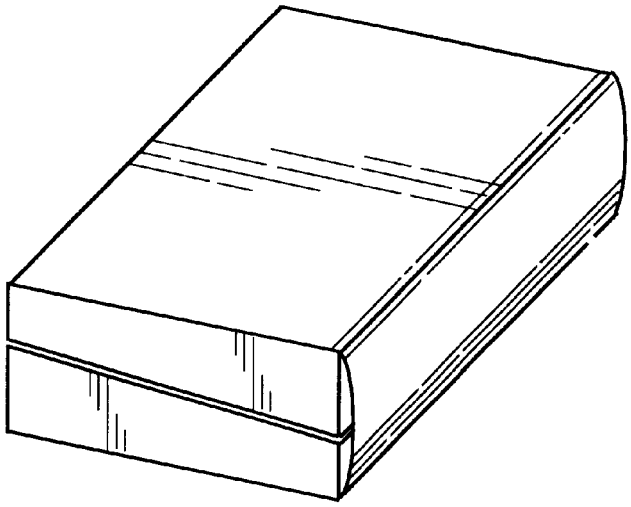

As shown in FIGS. 10 & 11, a folded-over assembly, may have an outer bag arrangement defined by projecting flaps which interconnect with zips or other closures. In this case the side flaps may incorporate stiffeners to impart rigidity. Since the shirts will be protected when the assembly is folded over by the outwardly facing bottom surfaces of the cases, it is possible to omit the stiffeners altogether and rely on the shirt frames.

Figure 12:
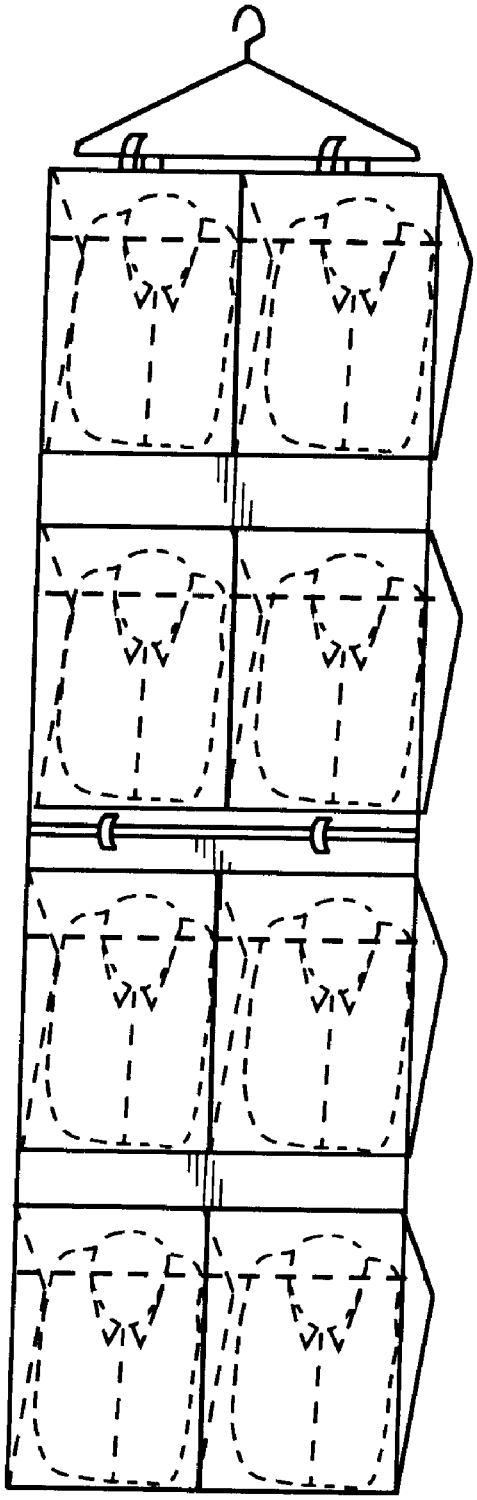

As shown in FIG. 12, a multi-case assembly may be arranged to be hung up in opened out form e.g. in a wardrobe.

A folded sheet (e.g. cardboard) or a wire (or plastic) frame sock frame may be provided.

An inner bag for personal items can be located within a collar, e.g. a cardboard collar, which is slotted or otherwise fitted over the collar tab of the shirt frame.

The case or combination of cases may have a handle or the like so that it can be carried as a separate item.

The case construction of the invention may be used to form multiple storage compartments in suit cases fitting easily together side-by-side and/or on top of each other.

The invention is particularly suitable for use with a shirt. It may however also be used with a blouse or other garment or any other suitable textile or other foldable article.

Instead of using plastics materials for reinforcement it is possible to use cardboard or any other suitable material.

What is claimed is:

1. A packaging case comprising:

an outer bag structure defining an openable storage container having top and bottom walls thereto;

said top wall of said bag structure comprises a first rectangular portion positioned at a greater height than a second rectangular portion including an inclined intermediate strip linking said first rectangular portion and said second rectangular portion;

a reinforcing structure providing transverse rigidity to the bag structure between said walls;

said transverse rigidity of the bag structure between said walls extending over a greater height between the walls, at one end region of the storage container relative to an opposite end region thereof; and said case having a frame separate from said reinforcing structure and comprising a flat panel which fits removably within the bag structure over the bottom wall and around which an article can be folded.

2. The packaging case as recited in claim 1 wherein the bottom wall is flat and the top wall is inclined.

3. The packaging case as recited in claim 1 wherein said packaging case reinforcing structure comprises rigid edge walls between said top and bottom walls.

4. The packaging case as recited in claim 1 wherein said case includes a shirt collar reinforcement which can fit within at least part of the periphery of a shirt collar within the case.

5. The packaging case as recited in claim 4 wherein said frame has an upstanding tab engageable with said shirt collar reinforcement.

6. The packaging case as recited in claim 1 wherein said case includes a supplementary container for small garments arranged to fit within the confines of a shirt collar within the case, said container including springy means positioned around portions of side walls of said container for support and being adjustable to fit the collar.

7. A packaging case according to claim 1 having an opening with closure flap thereto provided as said one end region separate from part of said top wall at said opposite end region to provide access for the folded article to the interior of the bag structure beneath said top wall part.

8. A packaging case for s shirt comprising;

an outer bag structure defining an openable storage container having top and bottom walls thereto:

said top wall of said bag structure comprises a first rectangular portion positioned at a greater height than a second rectangular portion including an inclined intermediate strip linking said first rectangular portion and said second rectangular portion;

a reinforcing structure providing transverse rigidity to the bag structure between said walls;

said transverse rigidity of the bag structure between said walls extending over a greater height between the walls, at one end region of the storage container relative to an opposite end region thereof; and said case having a frame comprising a flat panel which fits removably within the bag structure over the bottom wall with opposite free side edges of the panel closely adjacent to opposite side walls of the storage container and around which free side edges and an end of the panel a shirt can be folded.

9. A packaging case according to claim 8 characterized in that said frame comprises first and second flat panels joined by a hinge whereby the panels can be bent or pivoted about the hinge to lie one on top of the other with a shirt folded around the panels, said hinge being arranged to bend or pivot to form a curved transition between the panels.

10. A packaging case according to claim 9 wherein the hinge is defined by a strip with multiple side by side lines of weakness.

11. A packaging case according to claim 10 wherein the panels and the strip are formed integrally in one place.

* * * * *